US010903626B2

(12) United States Patent
Lee et al.

(10) Patent No.: US 10,903,626 B2
(45) Date of Patent: Jan. 26, 2021

(54) SPARK PLUG FOR INCREASING COMBUSTION SPEED OF GASOLINE ENGINE

(71) Applicants: Hyundai Motor Company, Seoul (KR); Kia Motors Corporation, Seoul (KR)

(72) Inventors: Tae-Won Lee, Incheon (KR); Jae-Man Cho, Seoul (KR); Hong-Kil Baek, Seoul (KR); Seung-Woo Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/655,640

(22) Filed: Oct. 17, 2019

(65) Prior Publication Data

US 2020/0203933 A1 Jun. 25, 2020

(51) Int. Cl.
*H01T 13/20* (2006.01)
*H01T 13/08* (2006.01)

(52) U.S. Cl.
CPC ..... *H01T 13/08* (2013.01); *H01T 13/20* (2013.01)

(58) Field of Classification Search
CPC ..... H01T 13/08; H01T 13/20
See application file for complete search history.

(56) References Cited

U.S. PATENT DOCUMENTS 3,300,672 A * 1/1967 Fisher ..... H01T 13/08 313/120
2008/0092839 A1* 4/2008 Hanashi ..... H01T 13/18 123/169 R
2012/0038263 A1* 2/2012 Katsuraya ..... H01T 13/32 313/144

FOREIGN PATENT DOCUMENTS

KR 10-0204626 B1 3/1999
KR 10-0451977 B1 9/2004
KR 10-1760412 B1 7/2017

* cited by examiner

*Primary Examiner* — Donald L Raleigh
(74) *Attorney, Agent, or Firm* — Morgan, Lewis & Bockius LLP

(57) ABSTRACT

A spark plug for increasing a combustion speed of a gasoline engine may include electrodes of a spark plug, which ignite a mixture of fuel and air in a combustion chamber of an internal combustion engine, wherein the electrodes of a spark plug are positioned at a position where a flow velocity is high, and one end portion of a body of the spark plug and an end portion of a cylinder head on which the spark plug is disposed are positioned on a diagonal line to induce a tumble flow downward and allow a flame generated at the spark plug to expand toward a center portion of the combustion chamber where turbulent flow energy is high, such that both an initial combustion speed and a main combustion speed are high.

5 Claims, 6 Drawing Sheets

SPARK PLUG FOR INCREASING COMBUSTION SPEED OF GASOLINE ENGINE

CROSS-REFERENCE TO RELATED APPLICATIONS

The present application claims priority to Korean Patent Application No. 10-2018-0162008, filed on Dec. 14, 2018, the entire contents of which is incorporated herein for all purposes by this reference.

BACKGROUND OF THE INVENTION

Field of the Invention

The present invention relates to a spark plug for increasing a combustion speed of a gasoline engine. More particularly, the present invention relates to a spark plug for increasing a combustion speed of a gasoline engine, in which electrodes of the spark plug, which implement initial combustion, are positioned at a position where a flow velocity is high, and a shape of a body of the spark plug and a shape of a mounting unit (cylinder head) are changed to induce a flow downward to allow a flame generated at the spark plug to expand toward a center portion of a combustion chamber where turbulent flow energy is high, such that both an initial combustion speed and a main combustion speed are high.

Description of Related Art

In general, a spark plug, which has a central electrode and a ground electrode which face each other in an axial direction and define a spark discharge gap, has been known as an ignition means for an internal combustion engine of a vehicle. The spark plug generates spark discharge in the spark discharge gap, and the spark discharge ignites a gaseous mixture in a combustion chamber of the internal combustion engine.

Flows of fluids (i.e., flows of the gaseous mixture) such as, for example, swirl flows or tumble flows are formed in the combustion chamber, and an ignition performance may be ensured as the fluids appropriately flow even in the spark discharge gap.

By the way, in accordance with a state in which the spark plug is attached in the internal combustion engine, a portion of the ground electrode attached to a tip portion of a housing is sometimes disposed at an upstream side of the spark discharge gap based on a direction of the flow. In the instant case, the flow in the combustion chamber is blocked by the ground electrode, and as a result, there is concern that the flow will stagnate in the vicinity of the spark discharge gap. As a result, there is concern that an ignition performance of the spark plug will deteriorate. That is, in accordance with the state in which the spark plug is attached in the internal combustion engine, there is concern that a problem of irregularity of the ignition performance of the spark plug will occur. Recently, an internal combustion engine, which utilizes a lean-burn mode, is often used. However, in the present internal combustion engine, there is concern that combustion stability will deteriorate in accordance with the state in which the spark plug is attached.

In a general gasoline engine, engine efficiency is increased (fuel economy is improved) as a combustion speed is increased. When a flame is generated at the spark plug and then a flame point propagates, an initial combustion speed becomes higher as a flow velocity is increased at a position where the flame is generated. When the flow velocity is increased and thus a turbulent flow is generated (main combustion), the combustion speed becomes higher as turbulent flow energy is increased.

However, the position where the flow velocity is high and the position where the turbulent flow energy is high are in a trade-off relationship, and as a result, there is a problem in that it is difficult to implement combustion under a condition in which both of the initial combustion speed and the main combustion speed are high.

That is, as illustrated in FIG. 1A, the flow velocity is low at a center portion of the combustion chamber and high at an external periphery of the combustion chamber. In contrast, as illustrated in FIG. 1B, because of a velocity deviation (dV/dt), the turbulent flow energy is high at the center portion of the combustion chamber and low at the external periphery of the combustion chamber.

In the instant case, the velocity deviation over time is large at the center portion of the combustion chamber because the flow velocity low and instable, and the velocity deviation over time is small at the external periphery of the combustion chamber because the flow velocity is high and stable.

That is, as illustrated in FIG. 2, a spark plug 1 is positioned at a position where the initial combustion speed, which is high at the position where the flow velocity is high, and the main combustion speed, which is high at the position where the turbulent flow energy is high, both are moderate, and as a result, there is a problem in that it is difficult to implement combustion under a condition in which both of the initial combustion speed and the main combustion speed are highest.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a spark plug for increasing a combustion speed of a gasoline engine, in which electrodes of the spark plug, which implement initial combustion, are positioned at a position where a flow velocity is high, and a shape of a body of the spark plug and a shape of a cylinder head on which the spark plug is mounted are changed to induce a flow downward to allow a flame generated at the spark plug to expand toward a center portion of a combustion chamber where turbulent flow energy is high, such that both an initial combustion speed and a main combustion speed are high.

Various aspects of the present invention are directed to providing a spark plug for increasing a combustion speed of a gasoline engine, in which electrodes of a spark plug 1, which ignite a mixture of fuel and air in a combustion chamber 21 of an internal combustion engine, are positioned at a position where a flow velocity is high, and one end portion of a body 10 of the spark plug and an end portion of a cylinder head 20 on which the spark plug is disposed are positioned on a diagonal line to induce a tumble flow downward and allow a flame generated at the spark plug 1 to expand toward a center portion of the combustion chamber where turbulent flow energy is high, such that both an initial combustion speed and a main combustion speed are high.

According to an exemplary embodiment of the present invention configured as described above, the electrodes of the spark plug, which implement initial combustion, are positioned at a position where a flow velocity is high, and a shape of the body of the spark plug and a shape of the cylinder head are changed to induce the flow downward to allow a flame generated at the spark plug to expand toward the center portion of the combustion chamber where turbulent flow energy is high, such that both the initial combustion speed and the main combustion speed are high, and as a result, engine efficiency may be improved.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 1A and FIG. 1B are views illustrating a flow velocity and turbulent flow energy resulting from a tumble flow, in which FIG. 1A illustrates that the flow velocity is low at a center portion of a combustion chamber and high at an external periphery of the combustion chamber, and FIG. 1B illustrates that because of a velocity deviation (dV/dt), the turbulent flow energy is high at the center portion of the combustion chamber and low at the external periphery of the combustion chamber.

FIG. 3A and FIG. 3B are views illustrating an exemplary embodiment of a spark plug for increasing a combustion speed of a gasoline engine according to an exemplary embodiment of the present invention, in which FIG. 3A is a view exemplarily illustrating a state in which the spark plug is disposed, and FIG. 3B is a view exemplarily illustrating the spark plug.

FIG. 4A, FIG. 4B and FIG. 4C are views illustrating another exemplary embodiment of the spark plug for increasing a combustion speed of a gasoline engine according to an exemplary embodiment of the present invention, in which FIG. 4A is a cross-sectional view exemplarily illustrating a state in which the spark plug is disposed, FIG. 4B is a view exemplarily illustrating the spark plug, and FIG. 4C is a view exemplarily illustrating a state in which an inclined surface formed on a body of the spark plug is provided in an intake direction thereof showing the relationship between the combustion speed and the tumble flow, in which FIG. 4A is a view showing that the turbulent flow energy at the time of ignition is increased as the tumble ratio is increased, in which FIG. 4B is a view showing that the combustion speed is increased, such that combustion time is decreased, in which FIG. 4C is a view showing that the combustion time resulting from the turbulent flow energy is decreased since the combustion speed is increased as the turbulent flow energy is increased and FIG. 5A, FIG. 5B and FIG. 5C are views illustrating another exemplary embodiment of the spark plug for increasing a combustion speed of a gasoline engine according to an exemplary embodiment of the present invention, in which FIG. 5A is a cross-sectional view exemplarily illustrating a state in which the spark plug is disposed, FIG. 5B is a view exemplarily illustrating the spark plug, and FIG. 5C is a view exemplarily illustrating a state in which an inclined surface formed on a body of the spark plug is provided in an intake direction thereof

FIG. 7 is a view exemplarily illustrating a state in which the spark plug for increasing a combustion speed of a gasoline engine according another exemplary embodiment of the present invention and a combustion chamber are disposed.

Figure 1A:
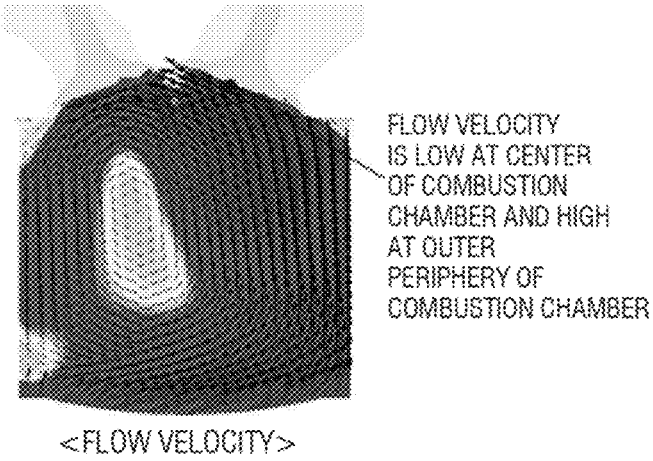
Figure 1B:
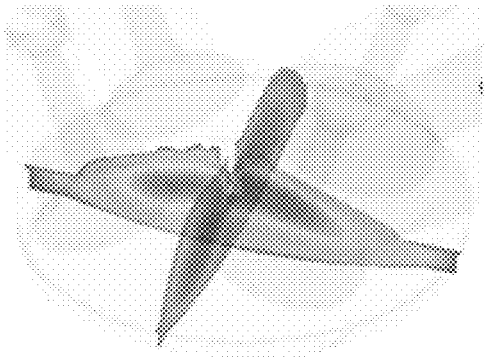
Figure 2:
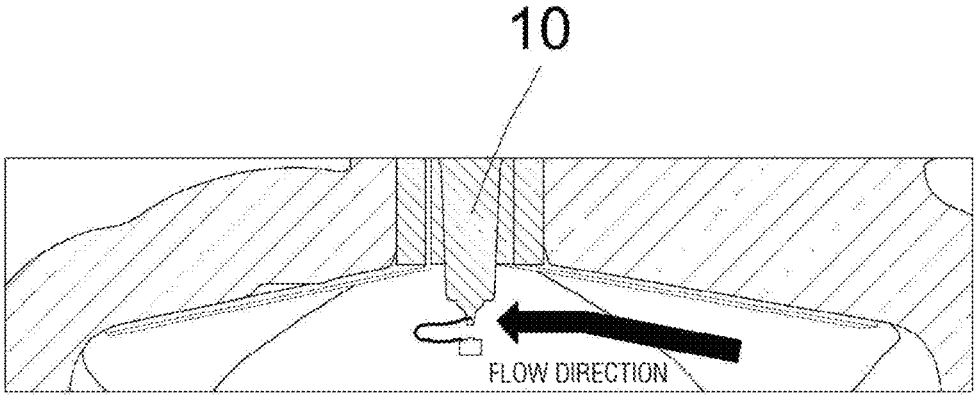
FIG. 2 is a cross-sectional view exemplarily illustrating a state in which a spark plug in the related art is disposed in a combustion chamber.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

A portion irrelevant to the description will be omitted to clearly describe the present invention, and the same or similar constituent elements will be designated by the same reference numerals throughout the specification.

Furthermore, terms or words used in the specification and the claims may not be interpreted as being limited to a general or dictionary meaning and may be interpreted as a meaning and a concept which conform to the technical spirit of the present invention based on a principle that an inventor can appropriately define a concept of a term to describe his or her own invention by the best method.

Hereinafter, according to an exemplary embodiment of the present invention will be described in detail with reference to the accompanying drawings.

Figure 3A:
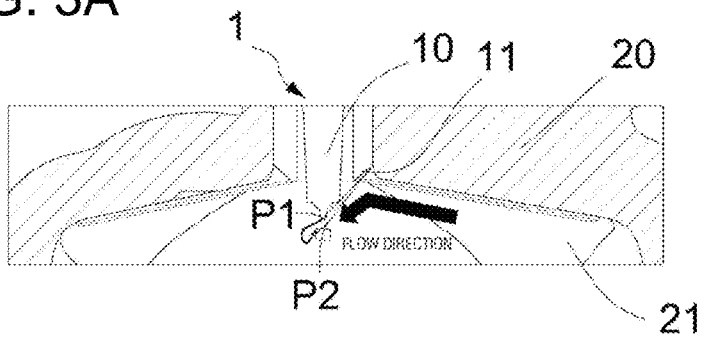
Figure 3B:
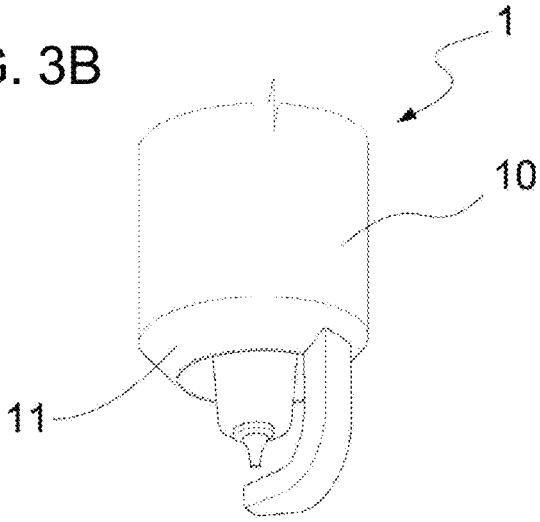

FIG. 3A and FIG. 3B are views illustrating an exemplary embodiment of a spark plug for increasing a combustion speed of a gasoline engine according to an exemplary embodiment of the present invention, in which FIG. 3A is a view exemplarily illustrating a state in which the spark plug is disposed, and FIG. 3B is a view exemplarily illustrating the spark plug.

According to an exemplary embodiment of the present invention, as illustrated in FIG. 3A, electrodes of a spark plug 1, which ignite a mixture of fuel and air in a combustion chamber 21 of an internal combustion engine, are positioned at a position where a flow velocity is high, and one end portion of a body 10 of the spark plug and an end portion of a cylinder head 20 on which the spark plug is disposed are positioned on a diagonal line to induce a tumble flow downward and allow a flame generated at the spark plug 1 to expand toward a center portion of the combustion chamber where turbulent flow energy is high, such that both an initial combustion speed and a main combustion speed are high.

That is, as illustrated in FIG. 3B, an inclined surface 11 formed at one end portion of the body 10 of the spark plug is formed around an entire circumference of the body 10, such that it is possible to actively induce the tumble flow in a direction indicated by the arrow illustrated in FIG. 3A, promoting combustion.

A relationship between the combustion speed and the tumble flow will be described below with reference to the FIG. 4A, FIG. 4B and FIG. 4C.

Figure 4A:
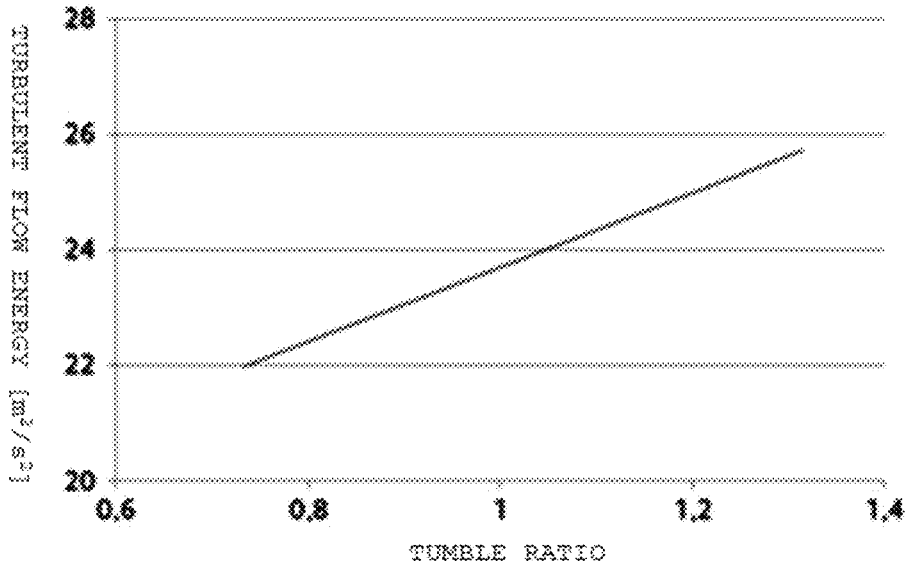

As shown in FIG. 4A, based on a tendency of the turbulent flow energy at the time of ignition with respect to the tumble ratio, it may be seen that a strong turbulent flow is formed at the final time of the compression stroke, promoting the combustion.

That is, the turbulent flow energy at the time of ignition is increased as the tumble ratio is increased.

Figure 4B:
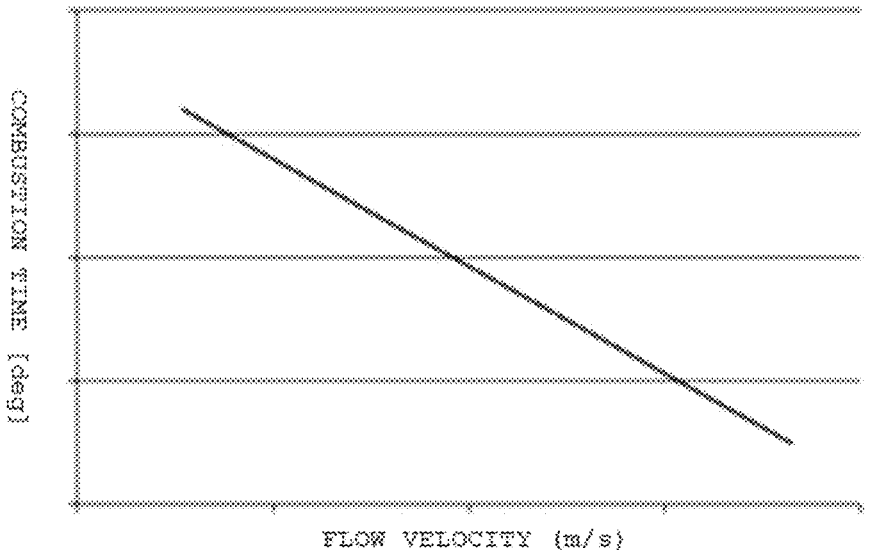

As shown in FIG. 4B, it may be seen that when the combustion speed is increased due to a strong flow at the initial time of ignition, the flow velocity is increased, and the combustion speed is increased, such that combustion time is decreased.

Figure 4C:
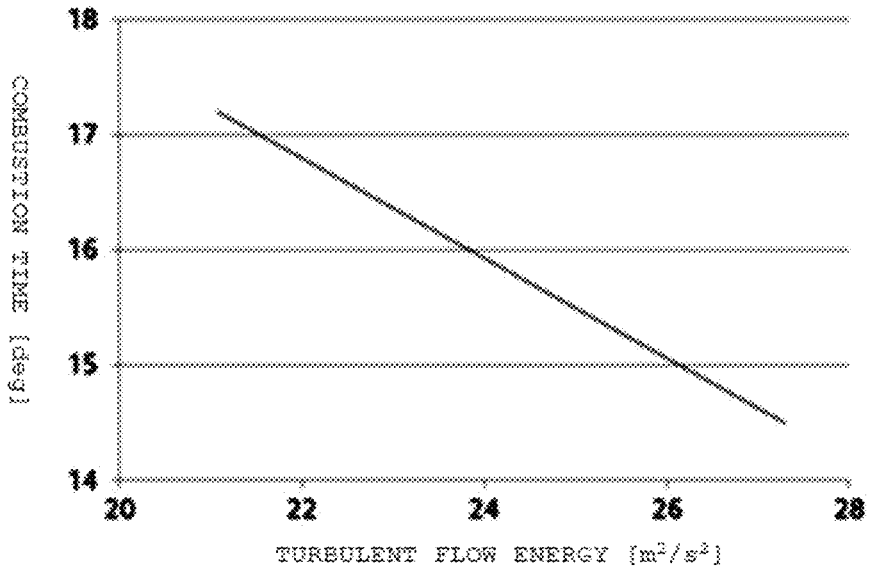

As shown in FIG. 4C, it may be seen that the combustion time resulting from the turbulent flow energy is decreased since the combustion speed is increased as the turbulent flow energy is increased.

To meet the conditions shown in the tables, the electrodes of the spark plug 1 according to an exemplary embodiment of the present invention are positioned at a position where the flow velocity is high, as illustrated in FIG. 3A, such that the initial combustion speed is increased, a flame is directed toward the center portion of the combustion chamber where the turbulent flow energy is high, and as a result, the main combustion speed may be increased.

In the instant case, an extension line of the inclined surface 11 formed on the body 10 of the spark plug may be directed toward a portion between an internal electrode center P1 and an external electrode center P2.

Figure 5A:
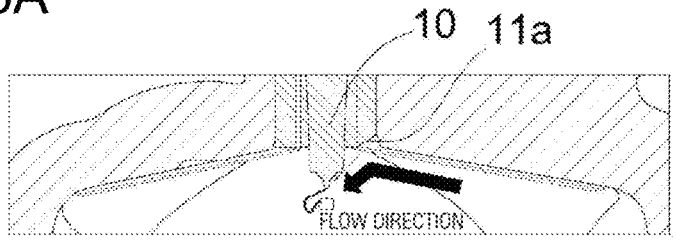
Figure 5B:
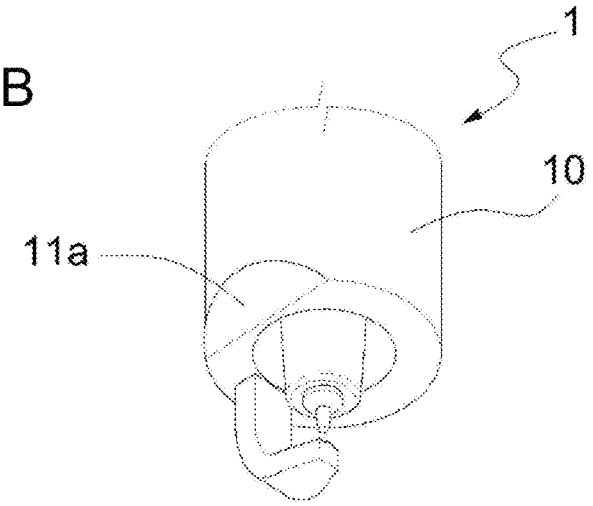
Figure 5C:
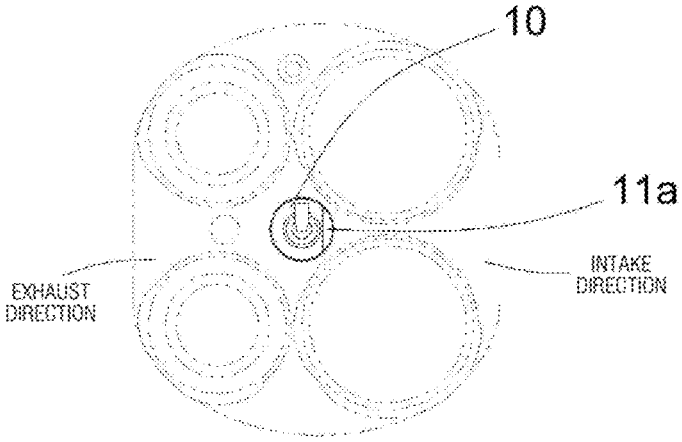

FIG. 5A, FIG. 5B and FIG. 5C are views illustrating another exemplary embodiment of the spark plug for increasing a combustion speed of a gasoline engine according to an exemplary embodiment of the present invention, in which FIG. 5A is a cross-sectional view exemplarily illustrating a state in which the spark plug is disposed, FIG. 5B is a view exemplarily illustrating the spark plug, and FIG. 5C is a view exemplarily illustrating a state in which an inclined surface formed on the body of the spark plug is provided in an intake direction thereof.

The basic configurations according to the exemplary embodiment of the present invention are the same as those of the aforementioned exemplary embodiment of the present invention.

However, as illustrated in FIG. 5C, an inclined surface 11*a*, which is formed at one end portion of the body 10 of the spark plug, is formed only in the intake direction to implement combustion under a condition in which both of the initial combustion speed and the main combustion speed are highest.

Figure 6:
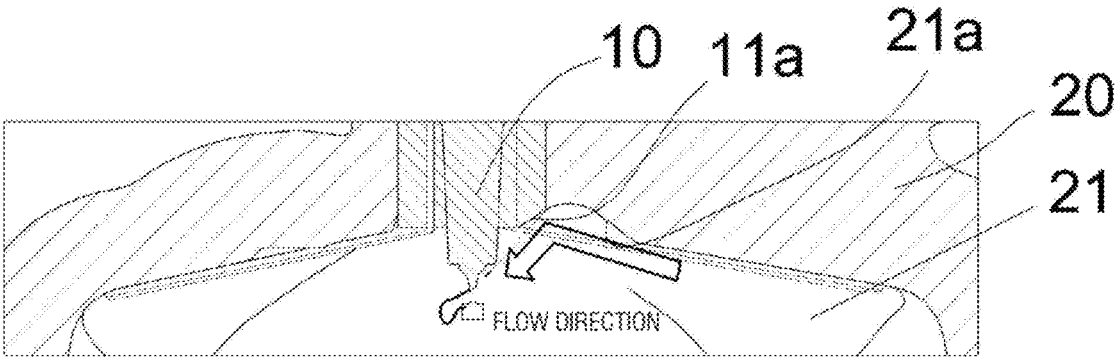
FIGS. 6 and 7 are views exemplarily illustrating a state in which the spark plug for increasing a combustion speed of a gasoline engine according to an exemplary embodiments of the present invention and a combustion chamber are disposed.
Figure 7:
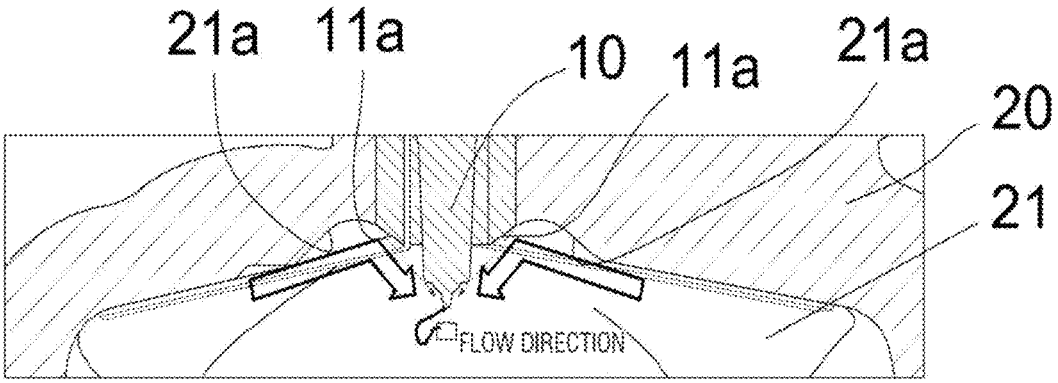

FIG. 6 and FIG. 7 are views exemplarily illustrating a state in which the spark plug for increasing a combustion speed of a gasoline engine according to exemplary embodiments of the present invention and the combustion chamber are disposed. The combustion chamber 21 of the cylinder head 20 has a curved groove 21*a* formed on the extension line of the inclined surface 11*a* of the body 10 of the spark plug, such that it is possible to more actively induce the flow.

FIG. 7 is a view exemplarily illustrating a state in which the spark plug for increasing a combustion speed of a gasoline engine according another exemplary embodiment of the present invention and a combustion chamber are disposed. A concave curved groove 21*a* is formed along a circle concentric with a body 10 of the spark plug installed in the combustion chamber 21 of the cylinder head 20, such that a flame generated at the spark plug 1 expands toward the center portion of the combustion chamber where turbulent flow energy is high, and as a result, both an initial combustion speed and a main combustion speed are high.

For example, because the flow is mostly formed in a direction from an intake part to an exhaust part, the curved groove 21*a* is formed to more actively induce the flow.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A spark plug for increasing a combustion speed of an internal combustion engine, the spark plug comprising:

wherein an end portion of a body of the spark plug, which ignite a mixture of fuel and air in a combustion chamber of the internal combustion engine, and an end portion of a cylinder head on which the spark plug is mounted are positioned on a diagonal line to induce a tumble flow downward and allow a flame generated at the spark plug to expand toward a center portion of the combustion chamber where turbulent flow energy is high, and wherein the body of the spark plug includes an inclined surface formed at an outer surface of the end portion of the body of the spark plug around an entire circumference of the body.

2. The spark plug of claim 1, wherein the body of the spark plug includes the inclined surface formed on the body of the spark plug, and wherein the combustion chamber of the cylinder head has a curved groove formed on an extension line of the inclined surface formed on the body of the spark plug.

3. The spark plug of claim 1, wherein the body of the spark plug includes the inclined surface formed only at a side at the end portion of the body of the spark plug.

4. The spark plug of claim 3, wherein the inclined surface formed at the end portion of the body of the spark plug is formed only in an intake direction thereof.

5. The spark plug of claim 1, wherein the body of the spark plug includes the inclined surface formed at the end portion of the body of the spark plug and protrudingly formed from a surface of the cylinder head.

* * * * *